US009995035B1

(12) United States Patent
Brekke

(10) Patent No.: US 9,995,035 B1
(45) Date of Patent: Jun. 12, 2018

(54) SUPPORT FOR FOUNDATION STRAP

(71) Applicant: Columbia Insurance Company, Omaha, NE (US)

(72) Inventor: Steven Brekke, Lakeville, MN (US)

(73) Assignee: Columbia Insurance Company, Omaha, NE (US)

( * ) Notice: Subject to any disclaimer, the term of this patent is extended or adjusted under 35 U.S.C. 154(b) by 0 days. days.

(21) Appl. No.: 15/433,790

(22) Filed: Feb. 15, 2017

(51) Int. Cl.
*E04B 1/41* (2006.01)
*E04B 1/38* (2006.01)

(52) U.S. Cl.
CPC ..... *E04B 1/41* (2013.01); *E04B 2001/405* (2013.01)

(58) Field of Classification Search
CPC ..... E04B 1/41; E04B 2001/4192; E04B 2001/405
USPC ..... 52/712, 2.25, 98
See application file for complete search history.

(56) References Cited

U.S. PATENT DOCUMENTS 1,692,166 A * 11/1928 Gates ..... E04G 17/0754 249/215
3,514,070 A * 5/1970 McArdle ..... E04G 17/06 249/207
3,728,836 A * 4/1973 Gates ..... E04G 17/0754 249/215
5,150,553 A 9/1992 Commins et al.
5,595,031 A 1/1997 Commins
6,401,406 B1 * 6/2002 Komara ..... E04B 1/4157 52/127.3
6,536,180 B1 * 3/2003 Rosenblat ..... E04C 5/163 249/215
6,796,099 B1 9/2004 Georges et al.
6,832,456 B1 * 12/2004 Bilowol ..... E04G 9/02 249/190
7,762,031 B2 * 7/2010 Leek ..... E04B 1/2608 249/93
8,448,404 B2 * 5/2013 Johnson, III ..... E04C 5/18 52/677
8,484,917 B2 * 7/2013 McClain ..... E04B 1/41 52/293.3
2002/0112436 A1 * 8/2002 Sander ..... E01C 11/14 52/677
2002/0133092 A1 * 9/2002 Oslund ..... A61M 25/09 600/585
2006/0037276 A1 * 2/2006 Sweeney ..... E04B 2/8617 52/712

(Continued)

OTHER PUBLICATIONS

Simpson Strong-Tie, Strapmate Strap Holder, Dec. 2014, 1 page.

*Primary Examiner* — Beth A Stephan
(74) *Attorney, Agent, or Firm* — Senniger Powers LLP

(57) ABSTRACT

A holdown connection assembly for attachment to a form used to make a concrete foundation includes a holdown including an elongate plate member having an upper section with a plurality of holes sized and shaped to receive fasteners to attach the holdown to a wood frame member supported by the concrete foundation. A lower section extends from the upper section and is configured to be at least partially embedded in the concrete foundation when the holdown is attached to the wood frame member. A support is configured to be mounted to the holdown to attach the holdown to the form. The support includes a wire member engageable with the holdown for locating the holdown relative to the form when the support is mounted to the holdown and attached to the form.

20 Claims, 16 Drawing Sheets

(56) References Cited

U.S. PATENT DOCUMENTS

| | | | | |
|---|---|---|---|---|
| 2006/0248843 | A1* | 11/2006 | Zapata | E04C 5/168 52/687 |
| 2009/0165409 | A1* | 7/2009 | McClain | E04B 1/41 52/293.3 |
| 2012/0227350 | A1* | 9/2012 | Wester | E04C 5/168 52/687 |
| 2014/0102028 | A1* | 4/2014 | Bethlendy, Jr. | E04C 1/39 52/503 |
| 2014/0352250 | A1* | 12/2014 | Karabas | E04G 21/122 52/712 |
| 2015/0345169 | A1* | 12/2015 | Heikkinen | F16G 11/00 52/98 |

* cited by examiner

SUPPORT FOR FOUNDATION STRAP

FIELD OF THE INVENTION

The present invention relates to holdowns, including foundation straps, for wood-to-concrete and concrete block installations, and more particularly to a support for a cast-in-place foundation strap.

BACKGROUND OF THE INVENTION

It is common practice to attach connectors between structural members of a building, such as between support walls and a buildings concrete foundation to reinforce these connections. In this instance, the connector is at least partially embedded in the concrete foundation. An example of such a connector is a strap tie holdown connector which is attached to an outer surface of the support wall.

The holdown is held in place prior to pouring the concrete foundations in which it is embedded. Thus, it is desirable that the positioning of the holdown be as accurate as possible. One way holdowns are held in place is to nail them directly to the form used when pouring the concrete foundation. However, this method is not capable of consistently and reliably setting a correct embedment depth of the holdown.

BRIEF SUMMARY OF THE INVENTION

In one aspect, a holdown connection assembly for attachment to a form used to make a concrete foundation generally comprises a holdown comprising an elongate plate member including an upper section having a plurality of holes sized and shaped to receive fasteners to attach the holdown to a wood frame member supported by the concrete foundation. A lower section extends from the upper section and is configured to be at least partially embedded in the concrete foundation when the holdown is attached to the wood frame member. A support is configured to be mounted to the holdown to attach the holdown to the form. The support comprises a wire member engageable with the holdown for locating the holdown relative to the form when the support is mounted to the holdown and attached to the form.

In another aspect, a holdown connection assembly for attachment to a form used to make a concrete foundation, the assembly generally comprises a holdown comprising an elongate plate member including an upper section having a plurality of holes sized and shaped to receive fasteners to attach the holdown to a wood frame member supported by the concrete foundation. A lower section extends from the upper section and is configured to be at least partially embedded in the concrete foundation when the holdown is attached to the wood frame member. The lower section includes an outer surface that faces away from the form when the holdown is attached to the form and an inner surface that faces toward the form when the holdown is attached to the forms. A support is configured to be mounted to the holdown to attach the holdown to the form. The support is shaped to engage the inner surface of the lower section of the holdown for locating the holdown relative to the form when the support is mounted to the holdown and attached to the form.

In yet another aspect, a support for a holdown connection assembly for attachment to a form used to make a concrete foundation generally comprises a wire member engageable with a holdown for locating the holdown relative to the form when the support is mounted to the holdown and attached to the form. The wire member includes a plurality of contiguous wire sections. At least some of the wire sections are configured for engaging the holdown for locating the holdown relative to the form when the support is mounted to the holdown and attached to the form.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE INVENTION

Figure 1:
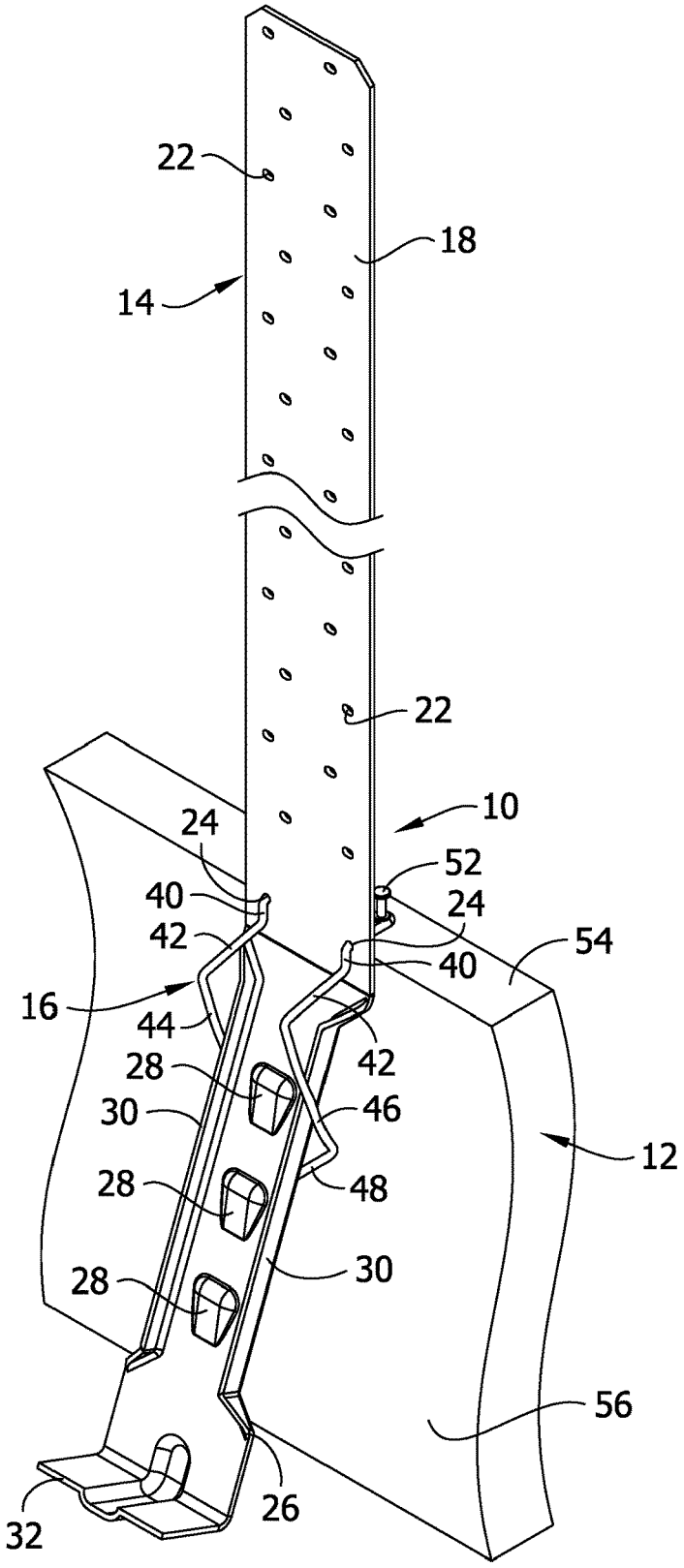
FIG. 1 is a perspective of a holdown connection assembly attached to a form used to make a concrete foundation.
Figure 2:
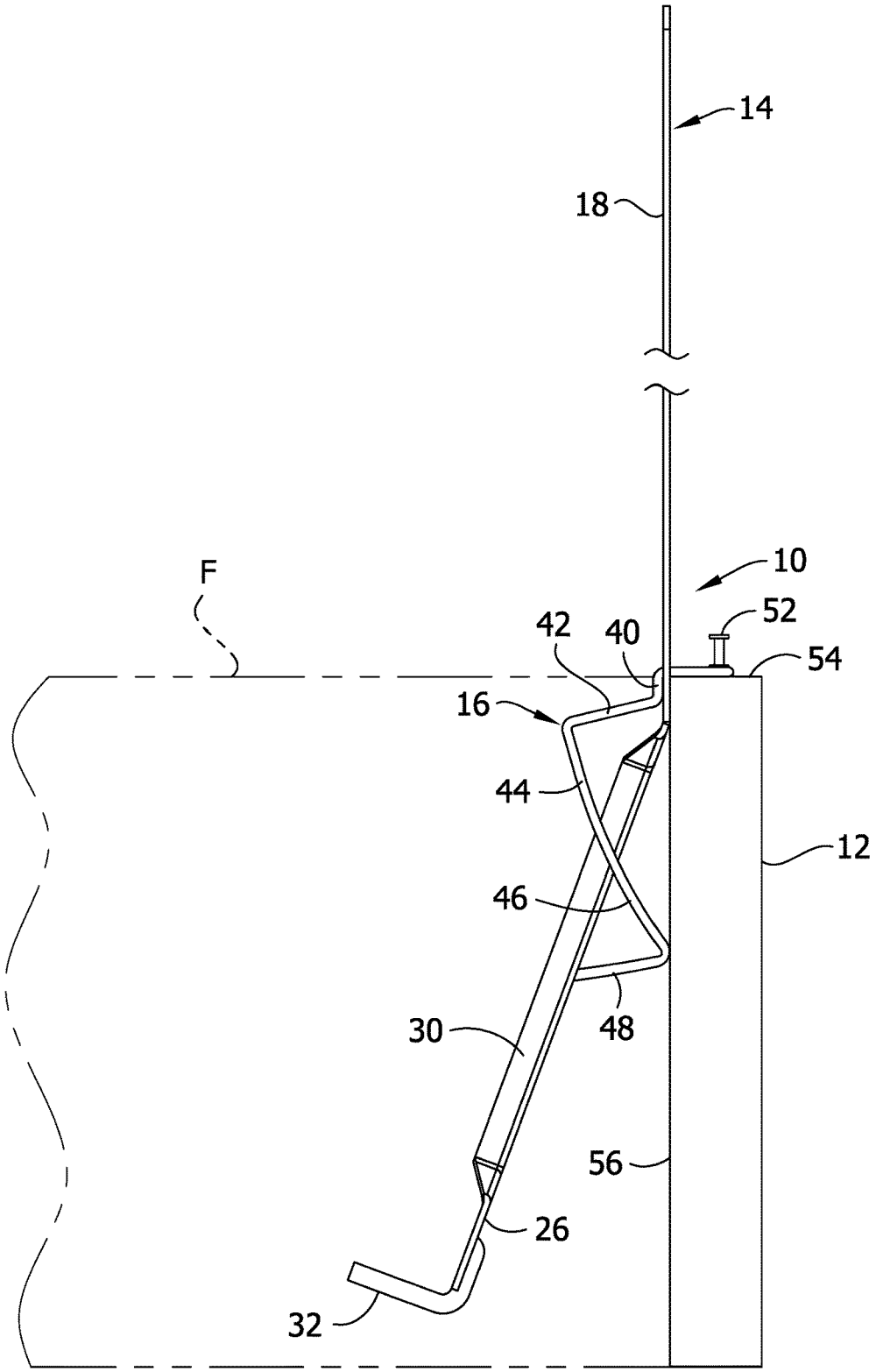
FIG. 2 is a side view thereof showing a concrete foundation in phantom.
Figure 3:
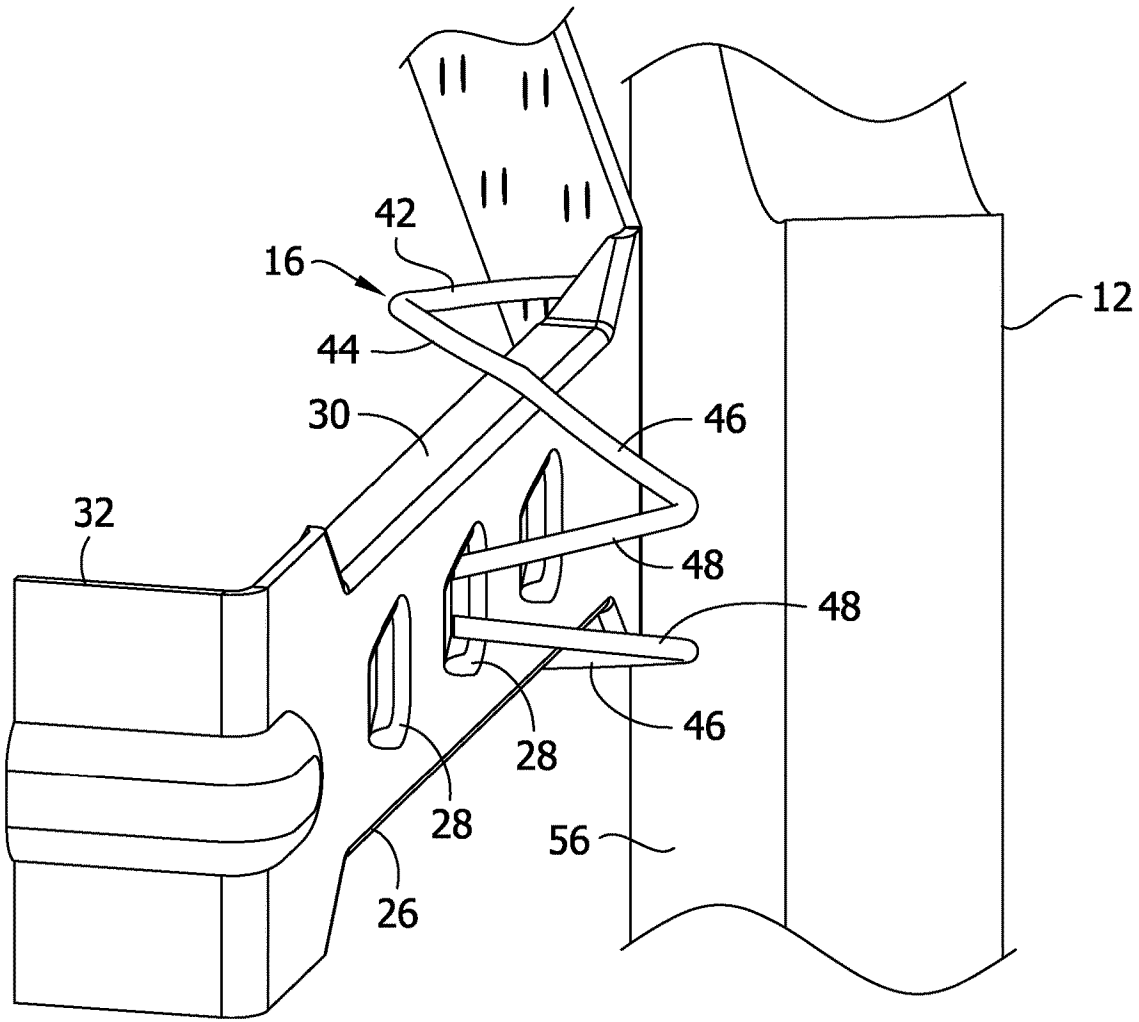
FIG. 3 is a fragmentary bottom side perspective thereof.
Figure 4:
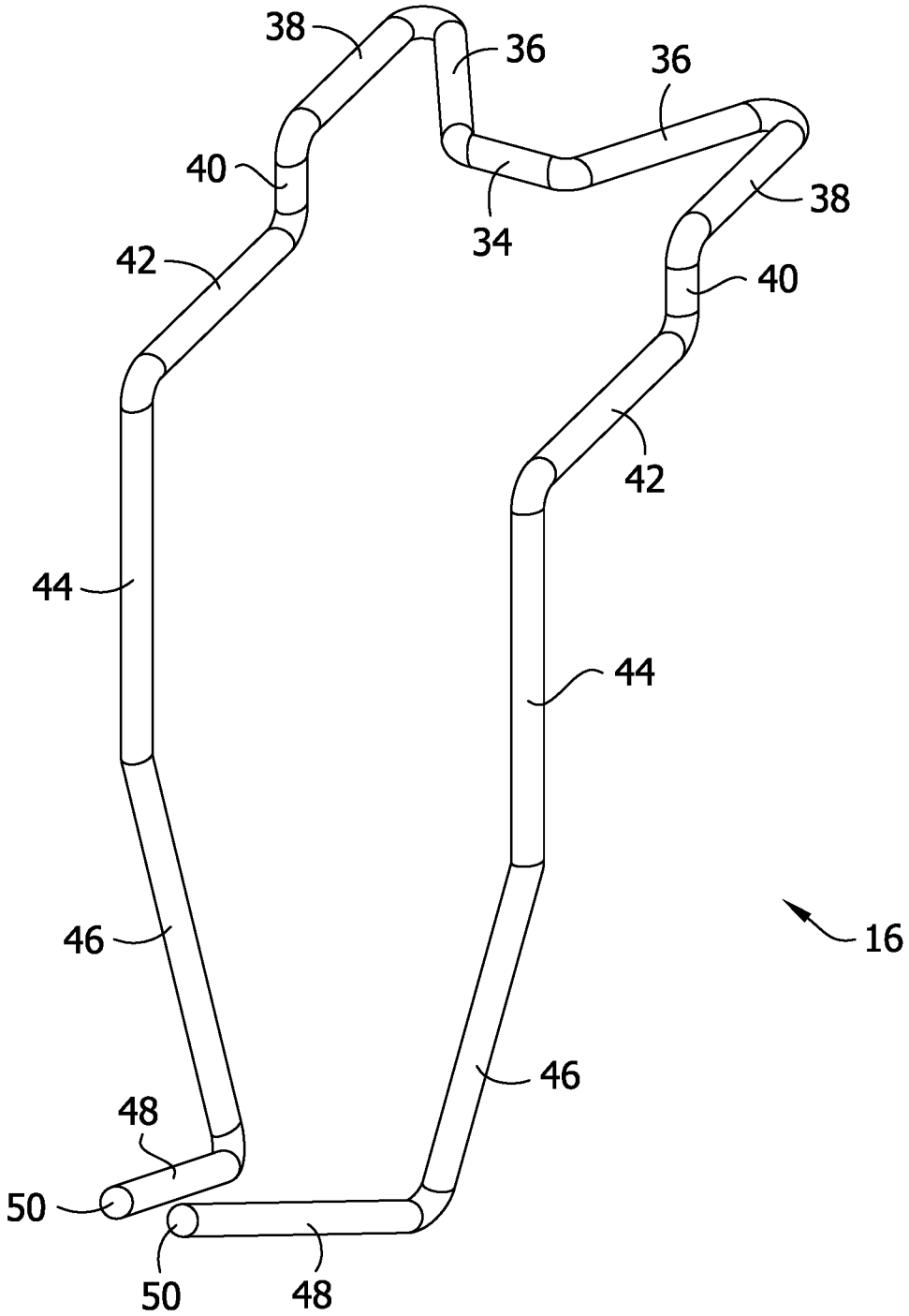
FIG. 4 is a perspective of the support.
Figure 5:
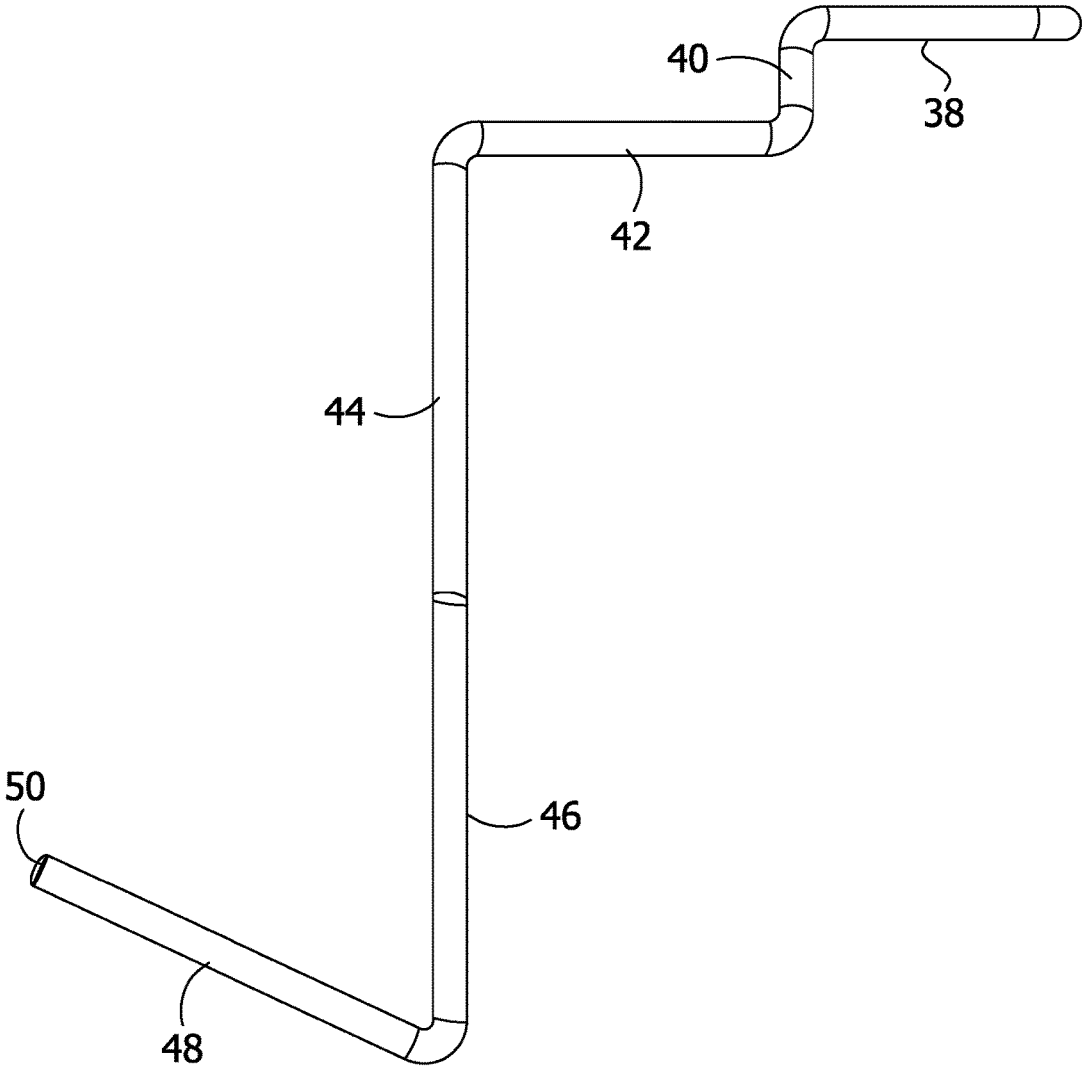
FIG. 5 is a side view thereof.

Referring to FIG. 1-3, a holdown connection assembly is indicated generally at 10. The assembly is attached to a form 12 (e.g., a form board) used when pouring a concrete foundation F for a building structure. The concrete foundation is schematically illustrated in phantom in FIG. 2. The assembly 10 comprises a holdown 14 and a support 16 attaching the holdown and mounted on the form 12. The support 16 maintains the holdown 14 in in a stable configuration and maintains a desired position of the holdown relative to the form 12. The support 16 may also reinforce the concrete near a top of the form 12 to reduce spalling (i.e., cracking) of the concrete.

The holdown 14 comprises a foundation strap including an elongate upper section 18 configured for attachment to a wood frame member (not shown) that extends vertically from the concrete foundation F and form 12. The upper section 18 comprises a plate member having holes 22 disposed therein shaped to receive fasteners such as nails or screws for fixedly attaching the holdown to the wood frame member. The plate member also includes holes 24 for receiving portions of the support 16 as will be explained in greater detail below. An elongate lower section 26 extends downward from the upper section 18 at an angle. The lower section 26 comprises a plate member having dimples 28 formed in an underside of the plate member and side flanges 30 extending alongside edge margins of the plate member. In the illustrated embodiment, there are three dimples 28 formed in the lower section 26. However, other numbers of dimples are envisioned without departing from the scope of the invention. The dimples 28 may also be omitted without departing from the scope of the invention. A heel section 32 extends generally orthogonally from the lower section 26. The lower section 26 and heel section 32 are configured to be embedded in the concrete foundation F when the holdown 14 is attached to the form 12. The heel section 32 interacts with the concrete to resist pull out of the holdown 14. In one embodiment, the holdown 14 is stamped from 12-14 gauge steel, although other suitable gauges and materials are within the scope of the present invention.

Referring to FIGS. 4-7, the support 16 comprises a wire formative made of a wire member bent to a configuration for attaching the holdown 14 to the form 12 to accurately and consistently locate the lower section 26 and heel section 32 of each holdown relative to the form. The support 16 includes a plurality of contiguous wire sections. The wire formative is generally symmetrical about a central vertical plane. The support 16 comprises a first wire section 34 extending generally horizontally. A pair of second wire sections 36 extend laterally at an angle from respective longitudinal ends of the first wire section 34. In the illustrated embodiment, the second wire sections 36 extend from the first wire section 34 at about a 30° angle. A pair of third wire sections 38 extend laterally from respective second wire sections 36. The third wire sections 38 extend in a direction generally orthogonal to the length of the first wire section 34. A pair of fourth wire sections 40 extend downward from respective third wire sections 38. In the illustrated embodiment, the fourth wire sections 40 extend downward from the third wire sections 38 at about a 90° angle. A pair of fifth wire sections 42 extend generally horizontally from respective fourth wire sections 40. A pair of sixth wire sections 44 extend downward from respective fifth wire sections 42. In the illustrated embodiment, the sixed wire sections 44 extend downward from the fifth wire sections 42 at about a 90° angle. A pair of seventh wire sections 46 extend downward from respective sixth wire sections 44 at an angle. In the illustrated embodiment, the seventh wire sections 46 extend from the sixth wire sections 44 at about a 14° angle. A pair of eighth wire sections 48 extend from respective seventh wire sections 46. The eighth wire sections 48 extend laterally toward each other and upward from the seventh wire sections 46. The eight wire sections 48 have free ends 50. In the illustrated embodiment, the eighth wire sections 48 extend from the seventh wire sections 46 at about a 67° angle. The wire sections 34, 36, 38, 40, 42, 44, 46, 48 could extend at other angles with respect to each other than those stated above without departing from the scope of the invention.

Figure 6:
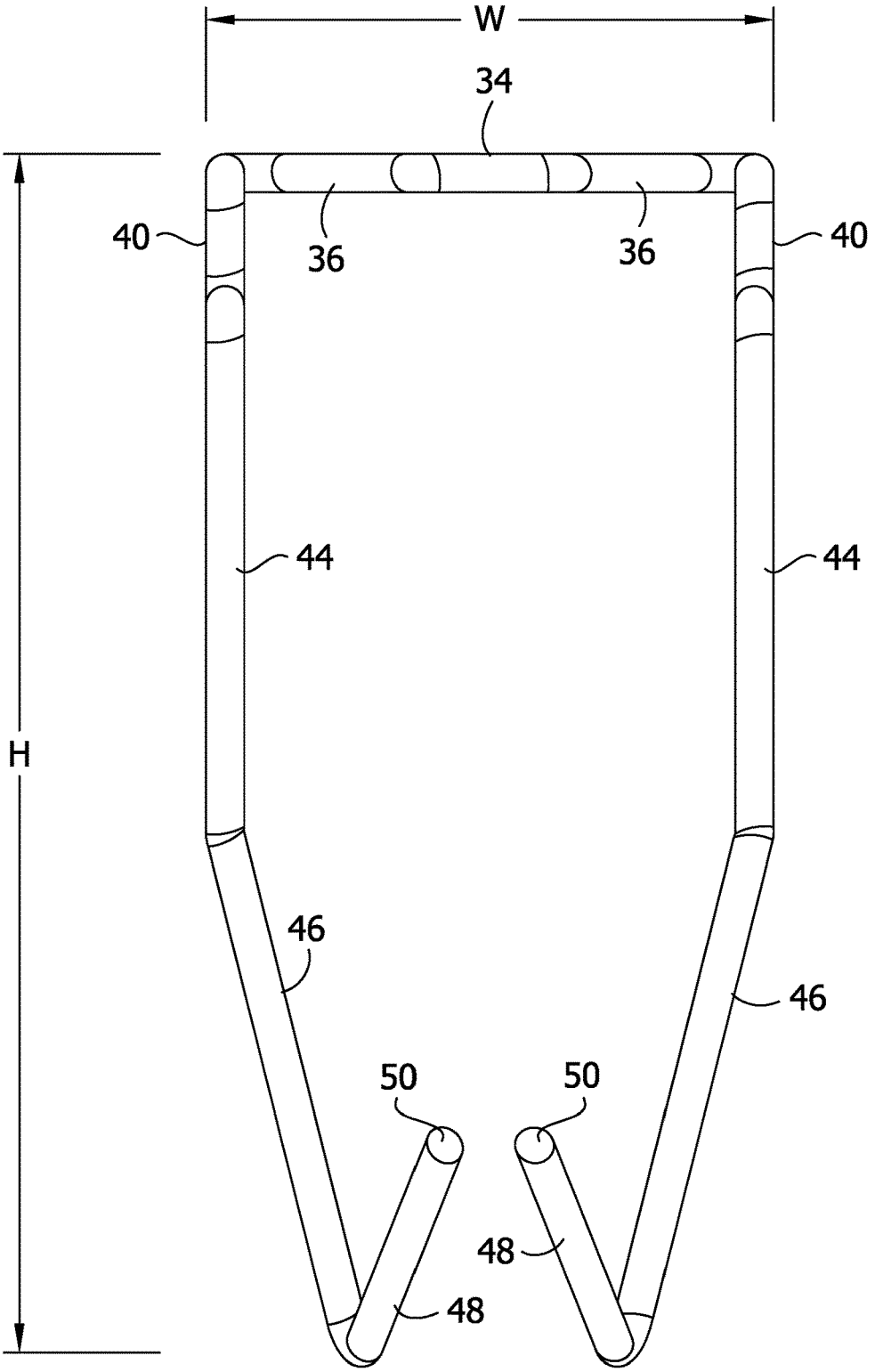
FIG. 6 is a front view thereof.
Figure 7:
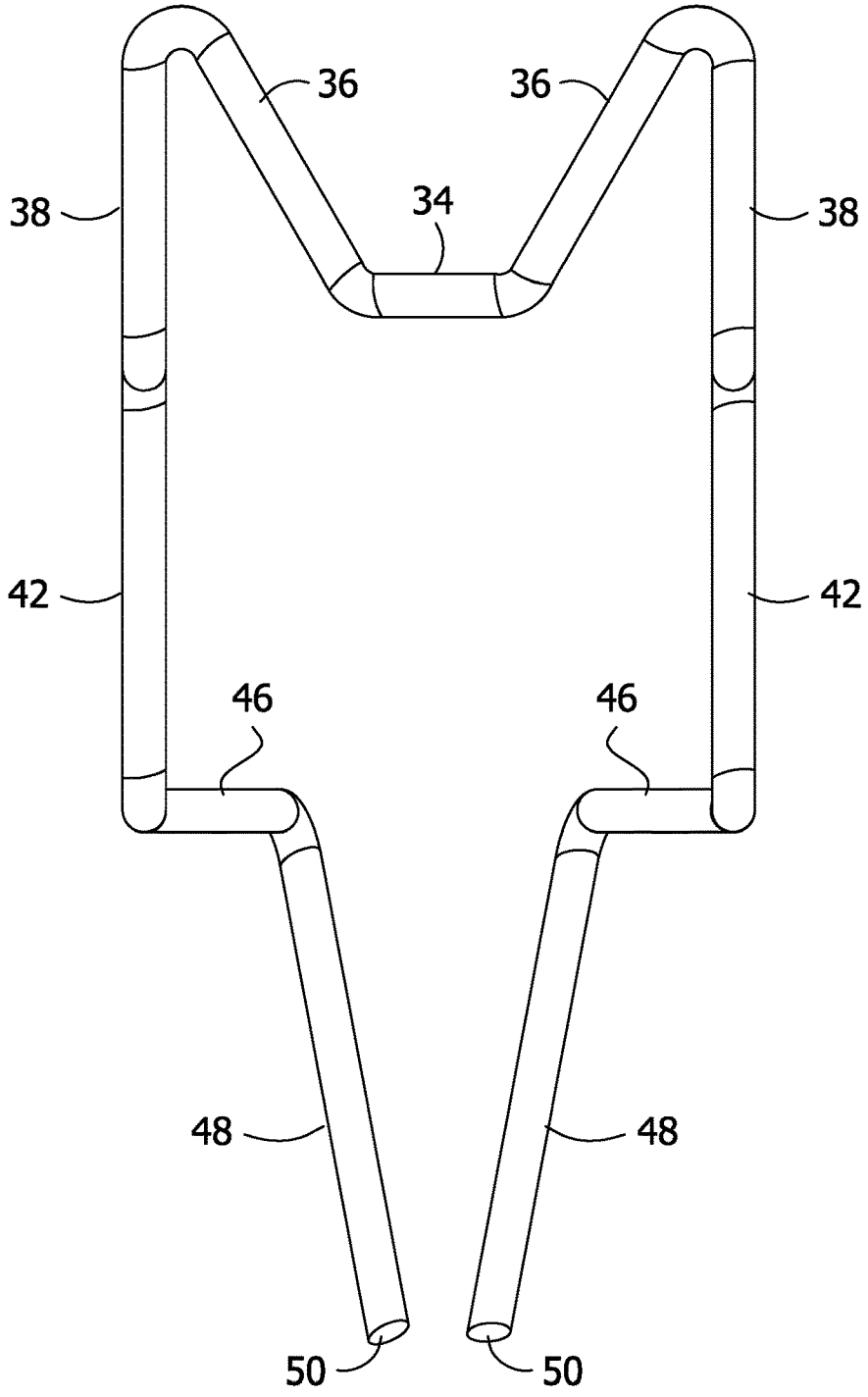
FIG. 7 is a top view thereof.

In the illustrated embodiment, the support 16 has a height H of about 4 inches (11.4 cm) and a width W of about 2⅛ inches (5.4 cm) (FIG. 6). The support 16 could have other dimensions without departing from the scope of the disclosure. In one embodiment, the support 16 is formed from a suitable material such as steel. In one embodiment, the support 16 is made from music wire. Other suitable materials are also envisioned without departing from the scope of the invention.

Referring back to FIGS. 1-4, the assembly 10 is formed by mounting the holdown 14 on the support 16. In particular, the free ends 50 of the eighth wire sections 48 are inserted through respective holes 24 in the upper section 18 of the holdown 14 from an inner surface of the upper section. The wire sections of the support 16 are then pulled through the holes 24 until the fourth wire sections 40 oppose an outer surface of the upper section 18 of the holdown 14. The sixth and seventh wire sections 44, 46 are then pulled outward to engage respective side flanges 30 on the lower section 26 of the holdown 14. Finally, the free ends 50 of the eighth wire sections 48 are inserted into a dimple 28 on the inner surface of the lower section 26. To attach the assembly 10 to the form 12, fasteners 52 (e.g., nails) are located at the bend between the second and third wire sections 36, 38. The fasteners 52 are then driven into an upper face 54 of the form 12 securing the support 16 to the form and thereby attaching the holdown 14 to the form.

As the concrete foundation F is being poured, the support 16 will retain the holdown 14 in place relative to the form 12 and in a constant configuration. Attachment of the holdown 14 to the support 16 causes the holdown to deform the support. The deformed support 16 resiliently engages with the holdown 14 and exerts forces against the holdown to maintain the holdown in place on the form 12. The third wire sections 38 are received in the holes 24 in the upper section 18 of the holdown 14 thereby providing a vertical holding force resisting vertical movement of the holdown relative to the form 12. The reception of the third wire sections 8 in the holes 24 also restrains the holdown 14 from horizontal movement along an inner face 56 of the form 12. The bends between the seventh and eighth wire sections 46, 48 engage the inner face 56 of the form 12, and the free ends 50 of the eighth wire sections 48 engage the lower section 26 of the holdown 14 in the dimples 28. This arrangement causes the eighth wire sections 48 to exert a lateral holding force on the lower section 26 of the holdown 14 maintaining a proper distance between the heel 32 and the face 56 of the form 12. Otherwise, as concrete is poured to the inside of the form 12 over the holdown 14, the lower section 26 is forced toward the face 56. Maintaining the proper distance between the heel 32 and the face 56 of the form 12 also holds the heel at a fixed vertical position. Thus, the support 16 fixes the vertical position of the holdown 14 thereby holding the lower section 26 and heel 32 at a desired embedment depth. In one example, the heel 32 is held at an embedment depth of about 10 inches (25 cm). However, the heel 32 could be held at other embedment depths without departing from the scope of the invention. Moreover, because the support 16 extends down along the lower section 26 of the holdown 14, the support can be at least partially embedded in the concrete. Therefore, the support 16 acts to reinforce the concrete helping to reduce spalling (i.e., cracking) of the concrete near the holdown 14. In one embodiment, the support 16 is positioned such that a majority of the support is embedded in the concrete foundation F.

Figure 8:
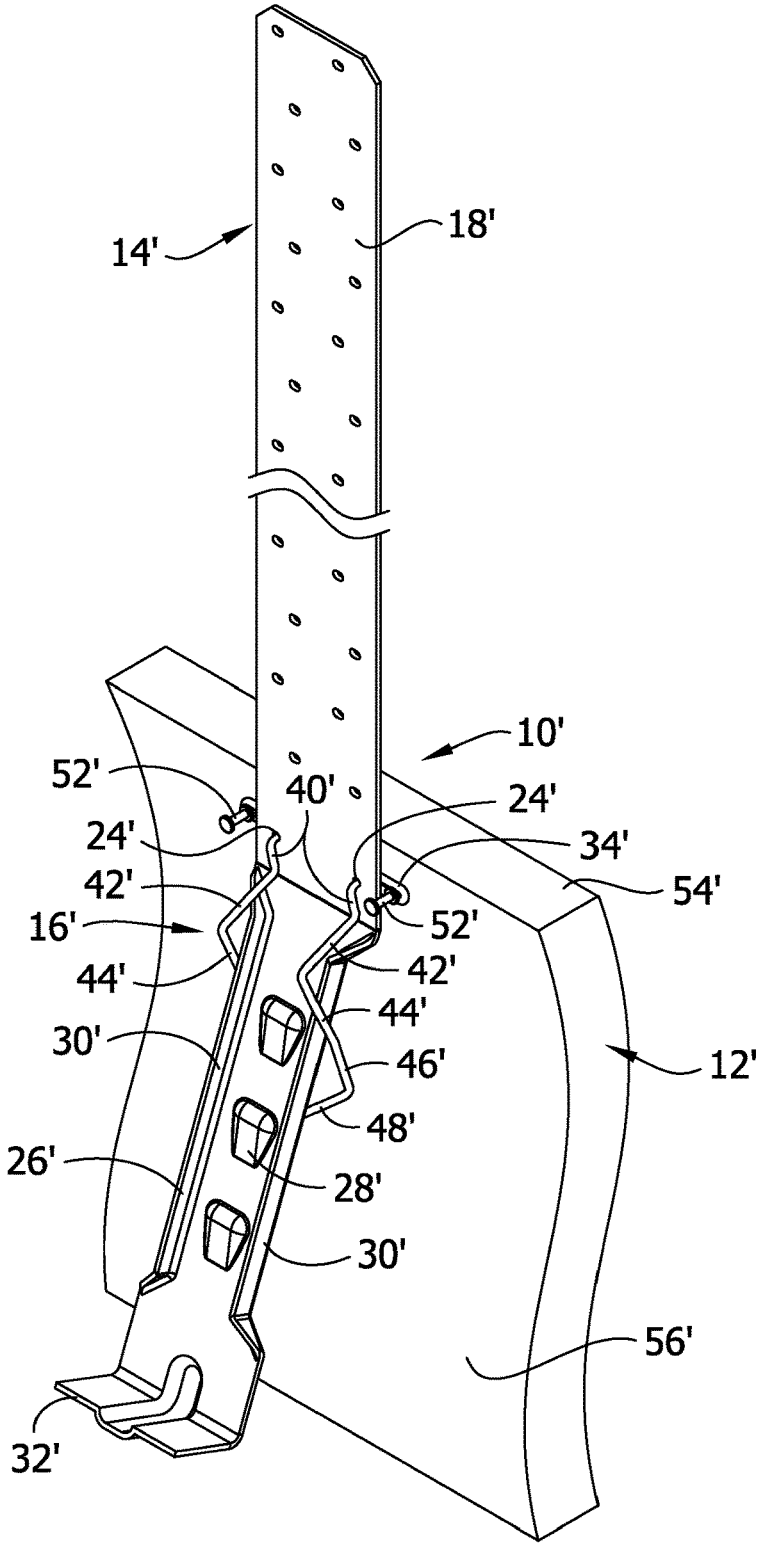
FIG. 8 is a perspective of a holdown connection assembly of another embodiment attached to a form used to make a concrete foundation.
Figure 9:
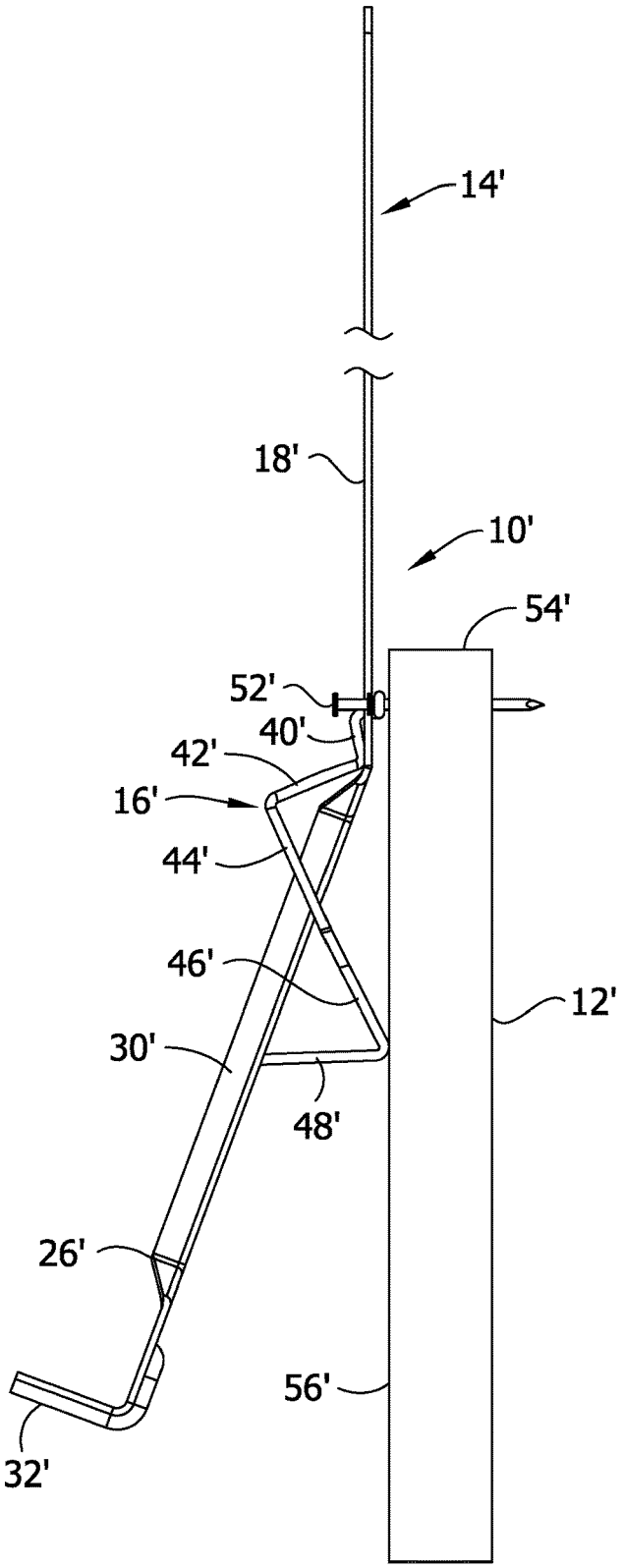
FIG. 9 is a side view thereof.
Figure 10:
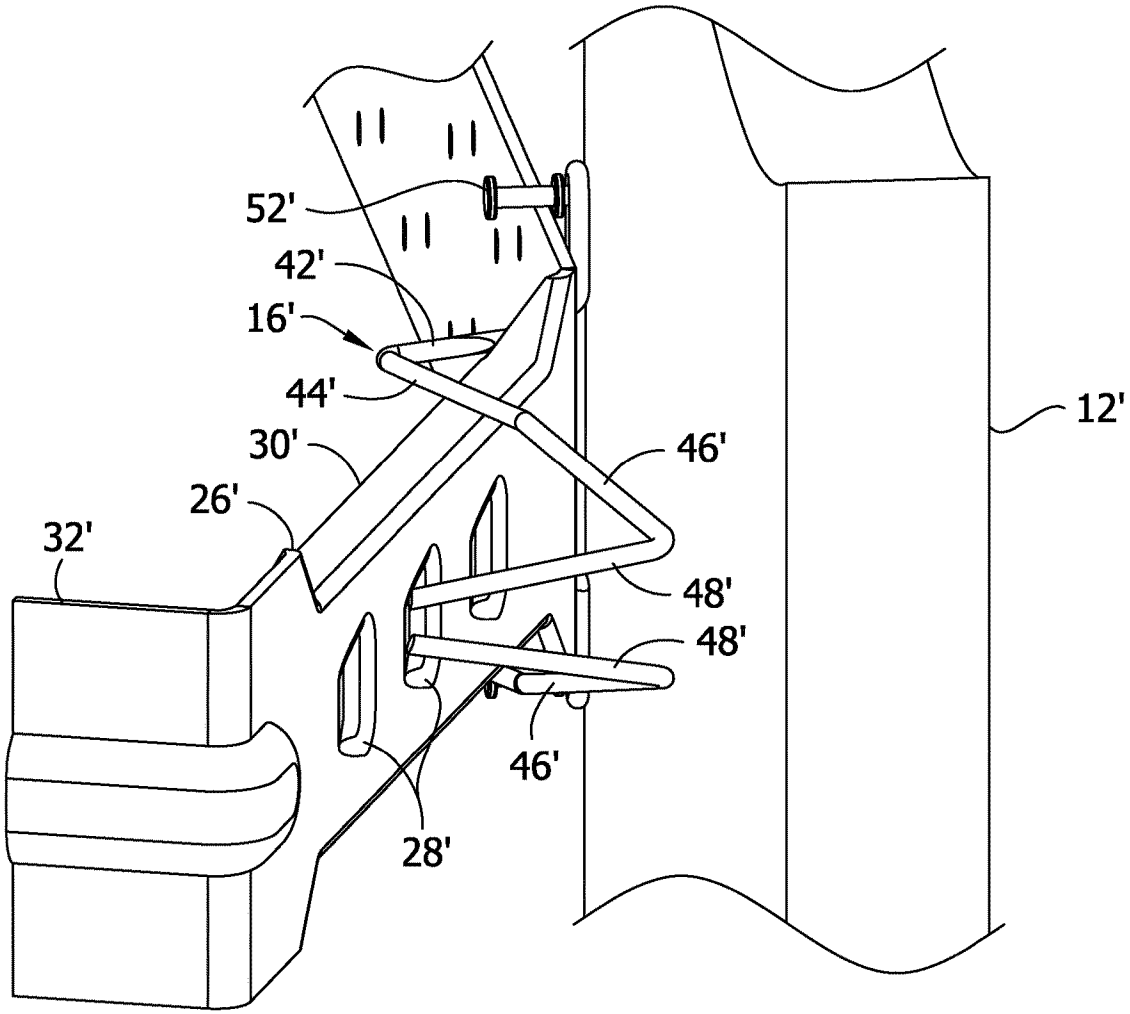
FIG. 10 is a fragmentary bottom side perspective thereof.
Figure 11:
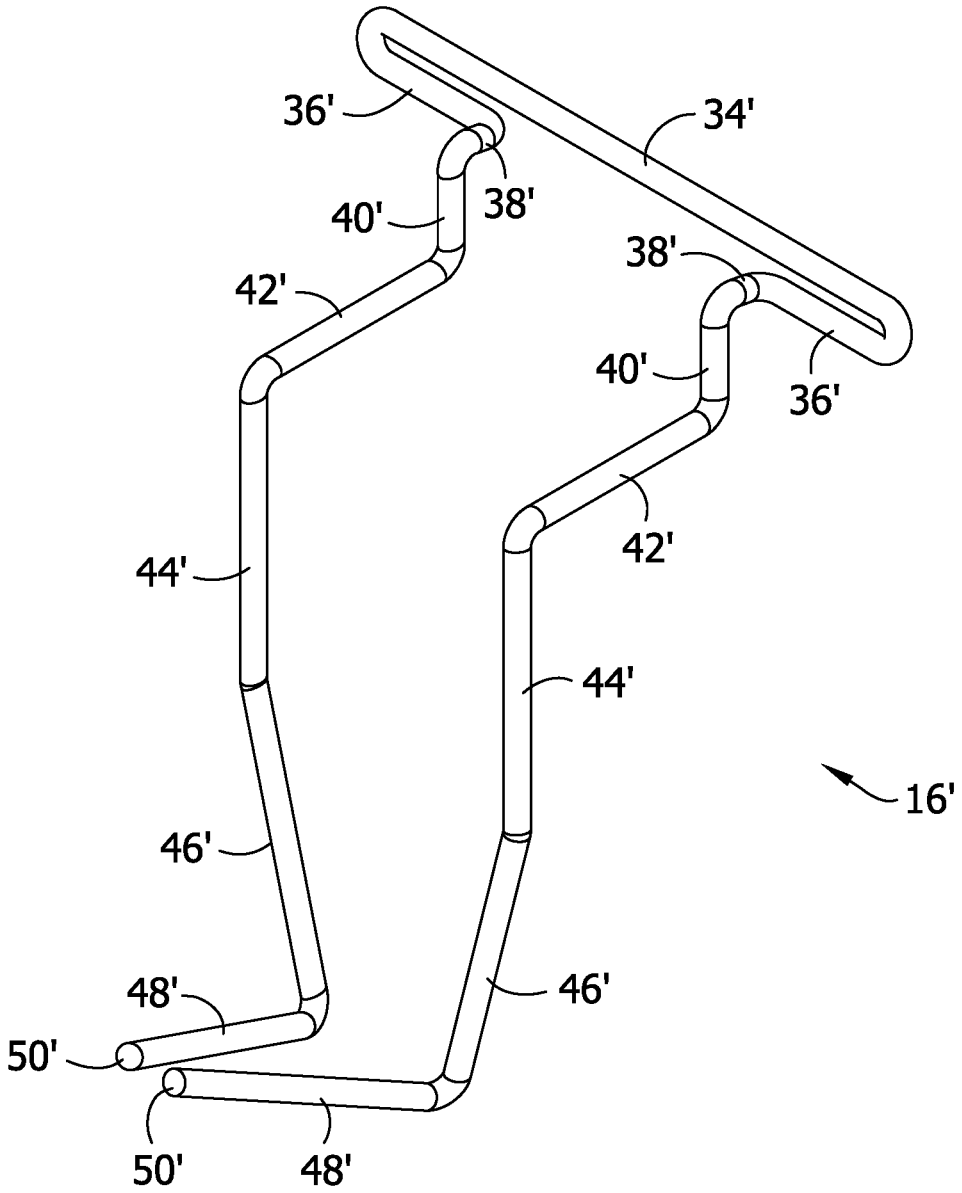
FIG. 11 is a perspective of the support of FIG. 10.
Figure 12:
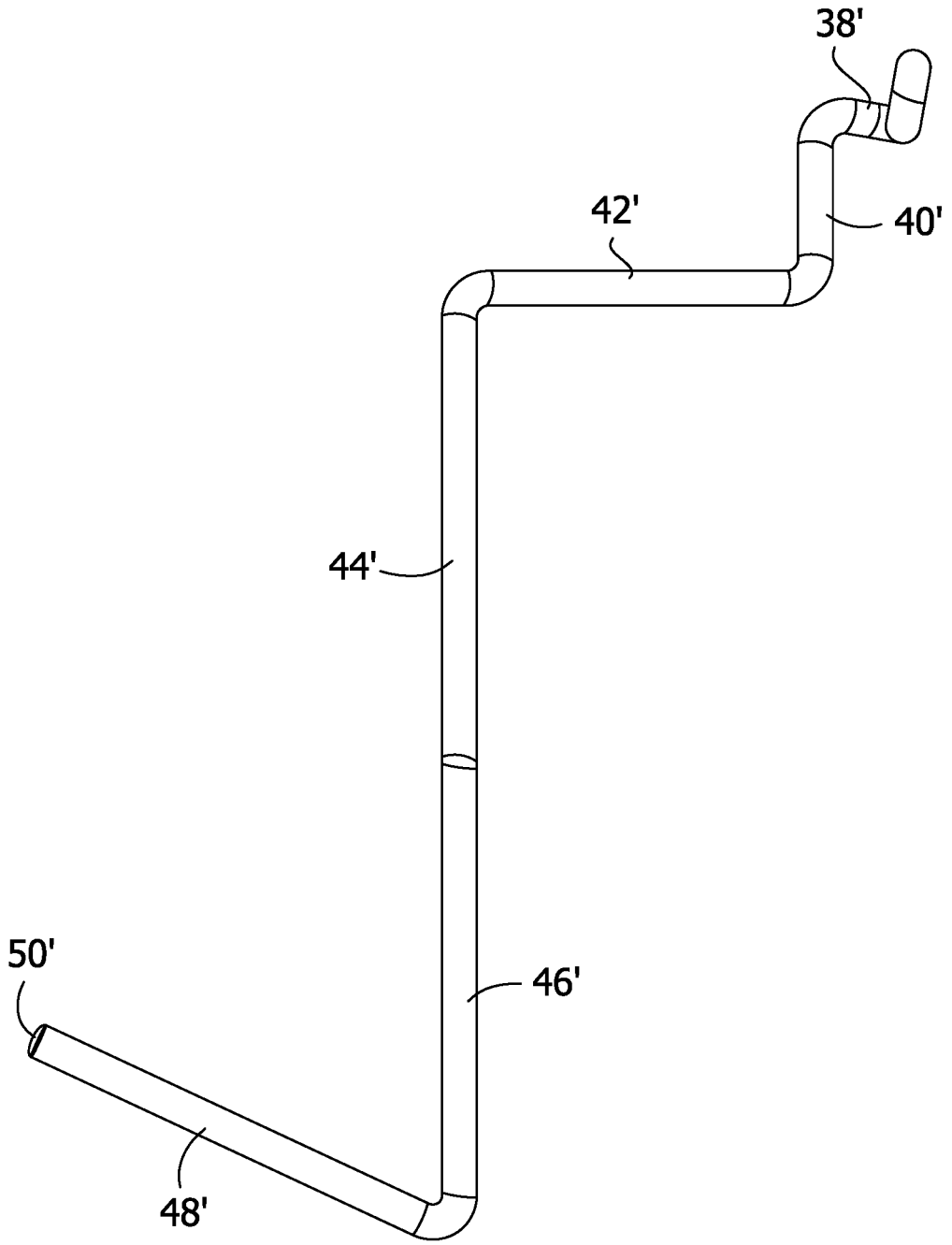
FIG. 12 is a side view thereof.

Referring to FIGS. 8-10, a holdown connection assembly of another embodiment is indicated generally at 10'. The assembly is attached to a form 12' (e.g., a form board) used to make a concrete foundation for a building structure. The assembly 10' comprises a holdown 14' and a support 16' mounted to the holdown and attached to the form 12' for holding the holdown in place on the form and maintaining a desired position of the holdown relative to the form. The holdown 14 is identical to the holdown 14 in the prior embodiment. However, the support 16' has a different configuration than the support 16 allowing the support 16' to be attached to a face 56' of the form 12' rather than to the top edge 54'. The support 16' otherwise functions the same as the support 16.

Referring to FIGS. 11-14, the support 16' comprises wire formative made of a wire member bent to a configuration for attaching the holdown 14' to the form 12' to accurately and consistently locate a lower section 26' and heel section 32' of the holdown relative to the form. The support 16' includes a plurality of contiguous wire sections. The wire formative is generally symmetrical about a central vertical plane. The support 16' comprises a first wire section 34' extending generally horizontally. A pair of second wire sections 36' are bent downward 180 degrees from respective longitudinal ends of the first wire section 34' such that the second wire sections extent generally parallel to the first wire section. A pair of third wire sections 38' extend laterally from respective second wire sections 36'. In the illustrated embodiment, the third wire sections 38' extend from the second wire sections 36' at about a 90° angle. A pair of fourth wire sections 40' extend downward from respective third wire sections 38'. In the illustrated embodiment, the fourth wire sections 40' extend downward from the third wire sections 38' at about a 90° angle. A pair of fifth wire sections 42' extend horizontally from respective fourth wire sections 40'. A pair of sixth wire sections 44' extend downward from respective fifth wire sections 42'. In the illustrated embodiment, the sixed wire sections 44' extend downward from the fifth wire sections 42' at about a 90° angle. A pair of seventh wire sections 46' extend downward from respective sixth wire sections 44' at an angle. In the illustrated embodiment, the seventh wire sections 46' extend from the sixth wire sections 44' at about a 14° angle. A pair of eighth wire sections 48' extend from respective seventh wire sections 46'. The eighth wire sections 48' extend laterally toward each other and upward from the seventh wire sections 46'. The eight wire sections 48' have free ends 50'. In the illustrated embodiment, the eighth wire sections 48' extend from the seventh wire sections 46' at about a 67° angle. The wire sections 34', 36' 38', 40', 42', 44', 46', 48' could extend at other angles with respect to each other without departing from the scope of the invention.

Figure 13:
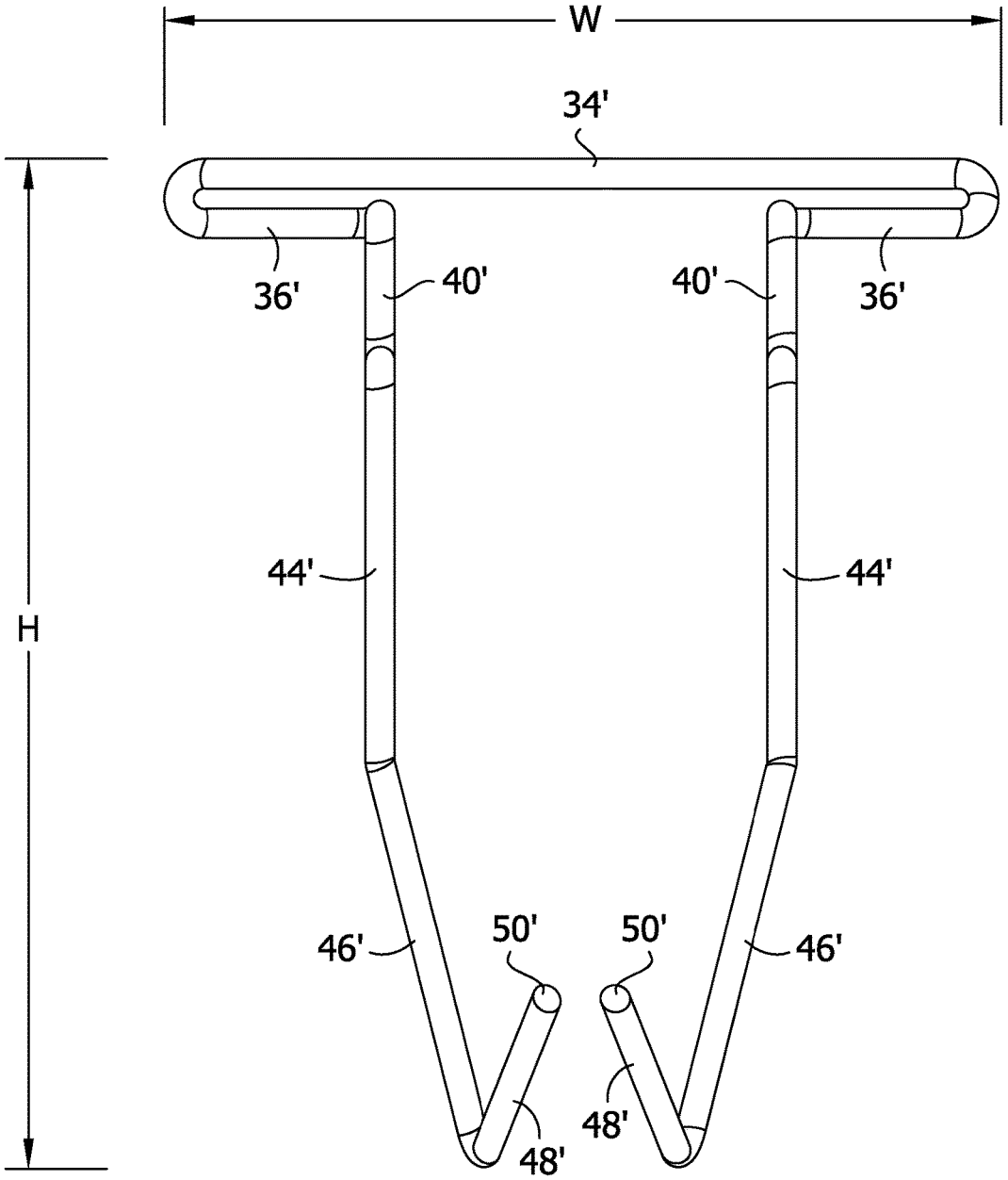
FIG. 13 is a front view thereof.
Figure 14:
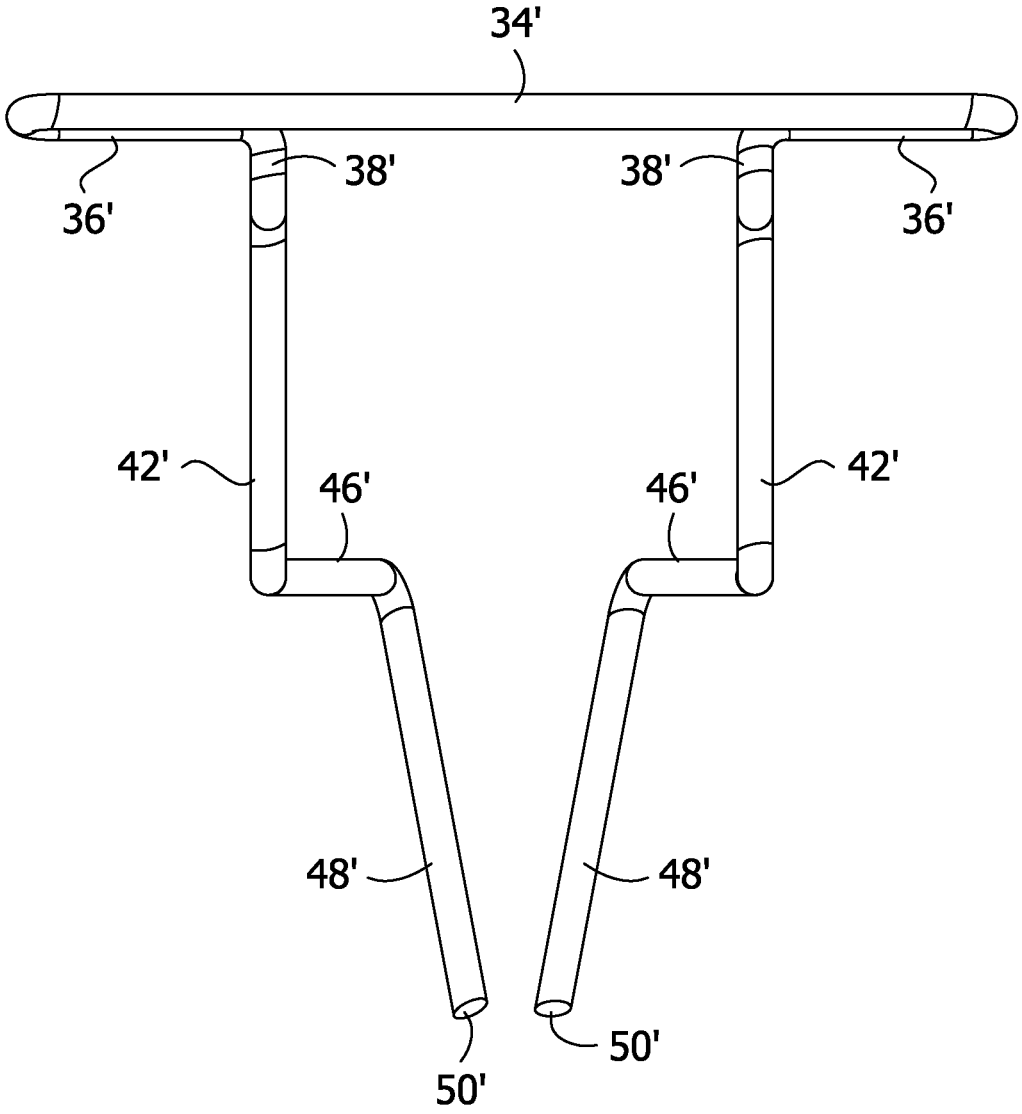
FIG. 14 is a top view thereof.

In the illustrated embodiment, the support 16' has a height H of about 4¾ inches (12.1 cm) and a width W of about 4 inches (10.2 cm) (FIG. 13). The support 16' could have other dimensions without departing from the scope of the disclosure. In one embodiment, the support 16' is formed from a suitable material such as steel. In one embodiment, the support 16' is made from music wire. Other suitable materials are also envisioned without departing from the scope of the invention.

Referring back to FIGS. 8-11, the assembly 10' is formed by mounting the holdown 14' on the support 16'. In particular, the free ends 50' of the eighth wire sections 48' are inserted through respective holes 24' in the upper section 18' of the holdown 14' from an inner surface of the upper section. The wire sections of the support 16' are then pulled through the holes 24' until the fourth wire sections 40' oppose an outer surface of the upper section 18' of the holdown 14'. The sixth and seventh wire sections 44', 46' are then pulled outward to engage respective side flanges 30' on the lower section 26' of the holdown 14'. Finally, the free ends 50' of the eighth wire sections 48' are inserted into a dimple 28 on an inner surface of the lower section 26'. To attach the assembly 10' to the form 12', fasteners 52' (e.g., nails) are located at the bend between the first and second wire sections 34', 36'. The fasteners 52' are then driven into the face 56' of the form 12' securing the support 16' to the form and thereby attaching the holdown 14' to the form.

Attachment of the holdown 14' to the support 16' causes the holdown 14' to deform the support 16'. The deformed support 16' engages with the holdown 14' and exerts forces against the holdown to maintain the holdown in place on the form 12'. As the concrete foundation is being poured, the support 16' will retain the holdown 14' in place with respect to the form and in a constant configuration. The third wire sections 38' are received in the holes 24' in the upper section 18' of the holdown 14' thereby providing a vertical holding force resisting vertical movement of the holdown relative to the form 12'. The reception of the third wire sections 38' in the holes 24' also restrains the holdown 14' from horizontal movement along an inner face 56' of the form 12'. The bends between the seventh and eighth wire sections 46', 48' engage the face 56' of the form 12', and the free ends 50' of the eighth wire sections 48' engage the lower section 26' of the holdown 14' in the dimples 28'. This arrangement causes the eighth wire sections 48' to exert a lateral holding force on the lower section 26' of the holdown 14' maintaining a proper distance between the heel 32' and the face 56' of the form 12'. Otherwise, as concrete is poured to the inside of the form 12' over the holdown 14' the lower section 26' is forced toward the face 56'. Maintaining the proper distance between the heel 32' and the face 56' of the form 12' also holds the heel at a fixed vertical position. Thus, the support 16' fixes the vertical position of the holdown 14' thereby holding the lower section 26' and heel 32' at a desired embedment depth. In one example, the heel 32' is held at an embedment depth of about 10 inches (25 cm). However, the heel 32' could be held at other embedment depths without departing from the scope of the invention. Moreover, because the support 16' extends down along the lower section 26' of the holdown 14', the support can be at least partially embedded in the concrete. Therefore, the support 16' acts to reinforce the concrete helping to reduce spalling (i.e., cracking) of the concrete near the holdown 14'. In one embodiment, the support 16' is positioned such that a majority of the support is embedded in the concrete foundation. In one embodiment, the support 16' is positioned such that an entirety of the support is embedded in the concrete foundation.

Figure 15:
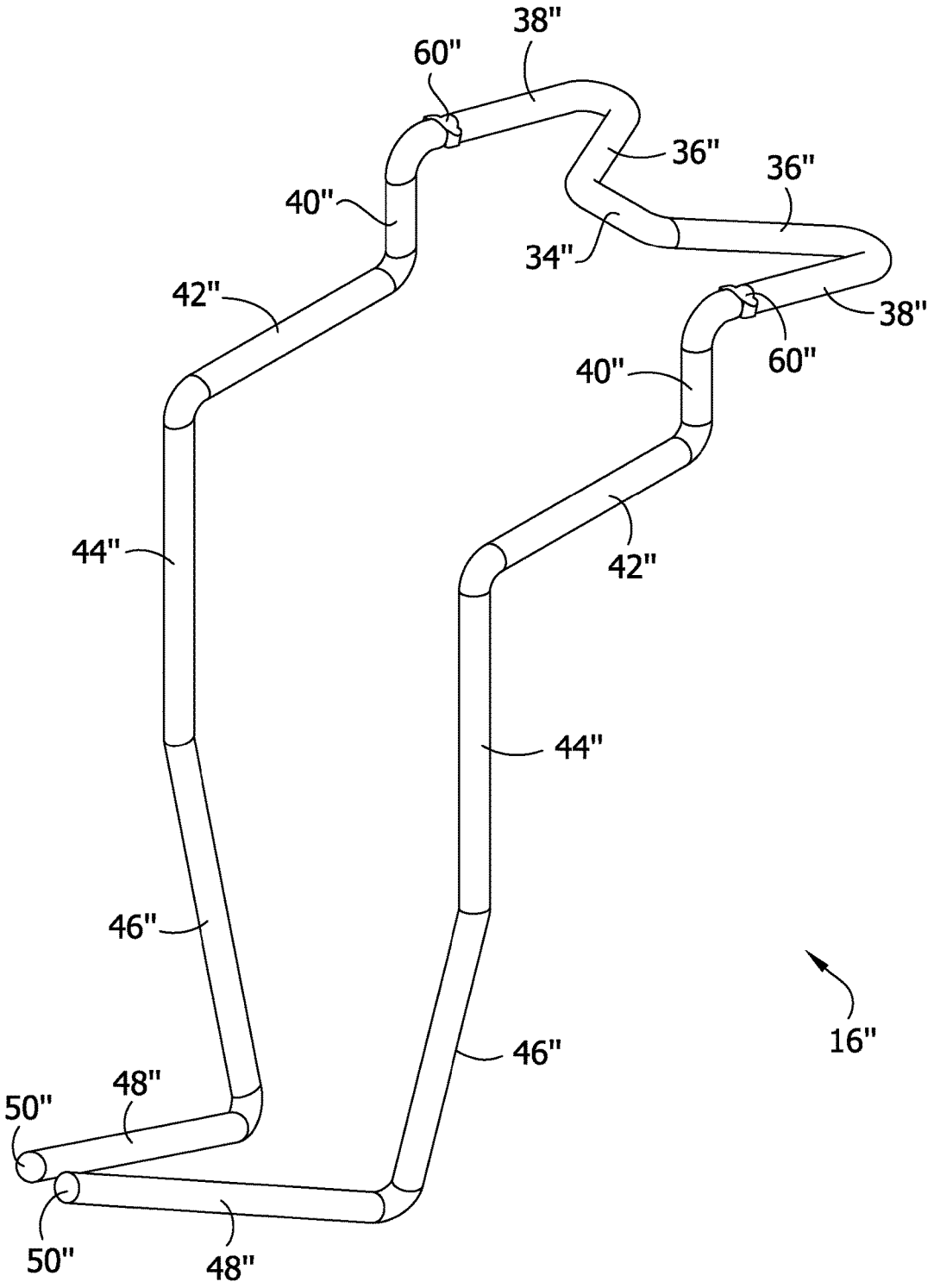
FIG. 15 is a perspective of a support of yet another embodiment.
Figure 16:
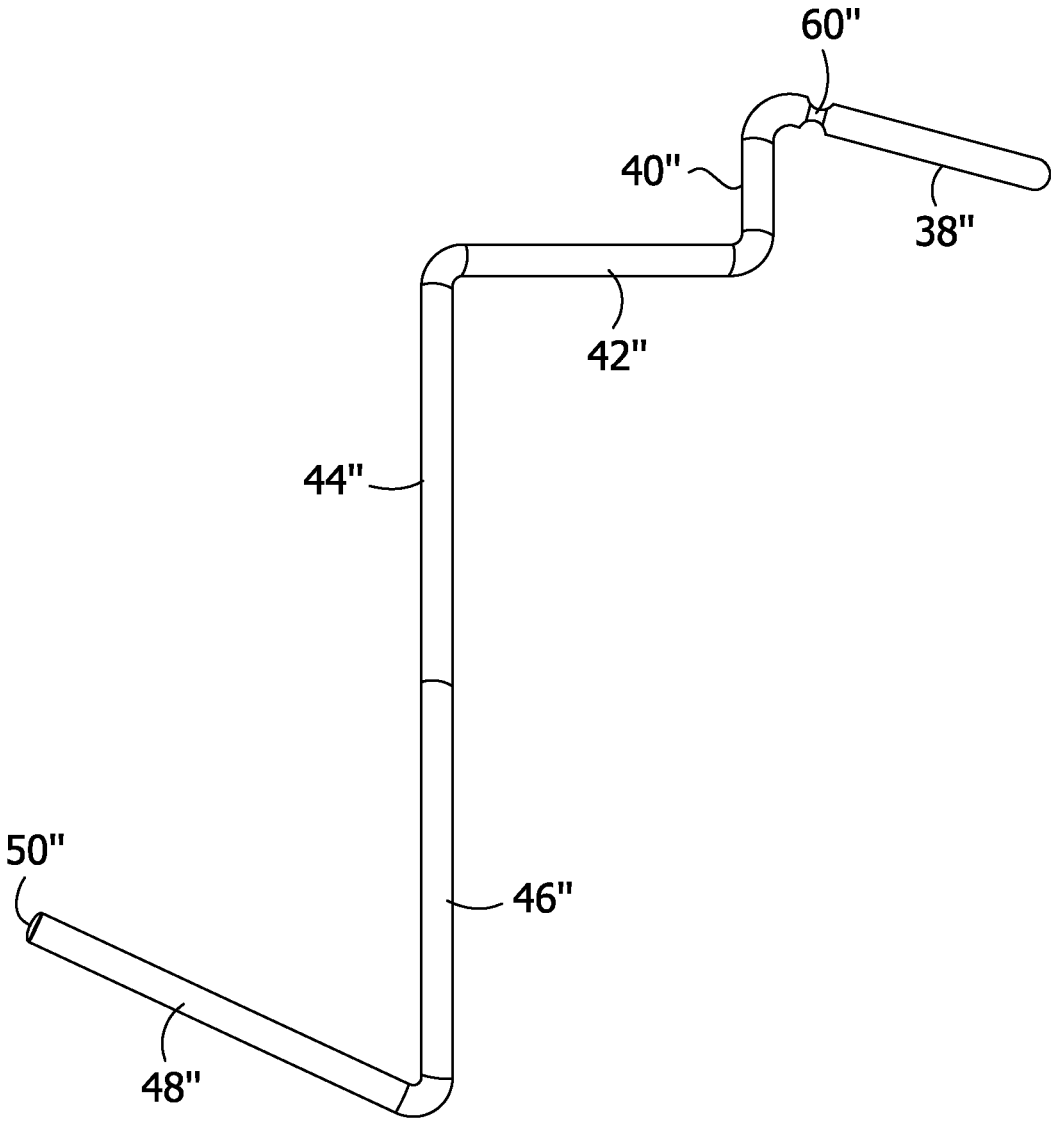
FIG. 16 is a side view thereof.

Referring to FIGS. 15 and 16, a support of another embodiment is indicated generally at 16". The support 16" comprises a wire formative made of a wire member bent to a configuration for attaching a holdown to a form to accurately and consistently locate a lower section and heel section of each holdown relative to the form. The support 16" is identical to the support 16 of the first embodiment except each of the third wire sections 38" has a crimp 60" providing a location of weakness on the support. In the illustrated embodiment, the crimps 60" form a frangible portion that allows an upper part of the support 16" to be selectively broken away after it is installed in the foundation. More specifically, the crimps 60" allow the support 16" to be broken off at the crimps to remove first, second, and third wire sections 34", 36", 38" from the support. This allows the upper section of the support 16" to be removed after installation. In some instances it may be necessary to remove the upper section of the support 16" to meet building code requirements.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

The invention claimed is:

1. A holdown connection assembly for attachment to a form used to make a concrete foundation, the assembly comprising:

a holdown comprising an elongate plate member including an upper section having a plurality of holes sized and shaped to receive fasteners to attach the holdown to a wood frame member supported by the concrete foundation, and a lower section extending from the upper section configured to be at least partially embedded in the concrete foundation when the holdown is attached to the wood frame member; and a support configured to be mounted to the holdown to attach the holdown to the form, the support comprising a wire member engageable with the holdown for locating the holdown relative to the form when the support is mounted to the holdown and attached to the form.

2. The assembly of claim 1, wherein the plurality of holes comprise a first plurality of holes, the holdown comprising a first locating hole, the wire member being configured to be received in the first locating hole for mounting the holdown on the support.

3. The assembly of claim 1, wherein the holdown comprises a second locating hole, the wire member being configured to be simultaneously received in the first and second locating holes for mounting the holdown on the support.

4. The assembly of claim 2, wherein the wire member comprises of wire sections and bends between adjacent wire sections, a first of the bends between adjacent wire sections defining a space for receiving a fastener to attach the support to the form.

5. The assembly of claim 4, wherein the wire member comprises a second bend between adjacent wire sections, the second bend being configured to engage the form, and one of the adjacent wire sections forming the second bend being configured to engage the lower section of the holdown to space the lower section from the form when the holdown connection assembly is mounted on the form.

6. The assembly of claim 5, wherein the lower section of the holdown includes a dimple, said one of the adjacent wire sections forming the second bend being configured to engage the holdown in the dimple to space the lower section from the form.

7. The assembly of claim 4, wherein the first bend is disposed opposite a top edge of the form for inserting the fasteners into the top edge of the form to attach the support to the form.

8. The assembly of claim 4, wherein the first bend is disposed opposite an upper face of the form for inserting the fasteners into the upper face of the form to attach the support to the form.

9. The assembly of claim 1, wherein the support comprises a frangible portion arranged for selectively breaking away at least an upper portion of the support.

10. A holdown connection assembly for attachment to a form used to make a concrete foundation, the assembly comprising:

a holdown comprising an elongate plate member including an upper section having a plurality of holes sized and shaped to receive fasteners to attach the holdown to a wood frame member supported by the concrete foundation, and a lower section extending from the upper section configured to be at least partially embedded in the concrete foundation when the holdown is attached to the wood frame member, the lower section including an outer surface that faces away from the form when the holdown is attached to the form and an inner surface that faces toward the form when the holdown is attached to the forms; and a support configured to be mounted to the holdown to attach the holdown to the form, the support being shaped to engage the inner surface of the lower section of the holdown for locating the holdown relative to the form when the support is mounted to the holdown and attached to the form.

11. The assembly of claim 10, wherein the lower section of the hold down includes a dimple, the support engaging the holdown in the dimple to space the lower section from the form when the support is attached to the form.

12. The assembly of claim 10, wherein the support comprises a wire formative including wire sections and bends between adjacent wire sections, one of the bends being configured to engage the form, and one of the adjacent wire sections forming said one bend being configured to engage the lower section of the holdown to space the lower section from the form when the holdown connection assembly is mounted on the form.

13. The assembly of claim 10, wherein the support comprises wire formative.

14. A support for a holdown connection assembly for attachment to a form used to make a concrete foundation, the support comprising a wire member engageable with a holdown for locating the holdown relative to the form when the support is mounted to the holdown and attached to the form, the wire member including free ends and a plurality of contiguous wire sections, at least some of the wire sections being configured for engaging the holdown for locating the holdown relative to the form when the support is mounted to the holdown and attached to the form, wherein opposite end portions of the wire member include the free ends of the wire member, the wire member including a mounting portion configured to mount the support on the form, the mounting portion and end portions being arranged so that the end portions of the wire member extend in side-by-side arrangement in the same direction outward from the mounting portion and form, and the free ends are positioned to engage the holdown and space it from the form when the support is mounted on the form.

15. The support of claim 14, wherein the wire member comprises bends between adjacent wire sections, a first of the bends between adjacent wire sections defining a space for receiving a fastener to attach the support to the form.

16. The support of claim 15, wherein a second of the bends between adjacent wire sections located between the mounting portion and one of the end portions, is configured to engage a surface of the form to position the free end of said one end portion at a location spaced laterally outwardly from the surface of the form, and a third of the bends between adjacent wire sections located between the mounting portion and the free end of the other of the end portions is configured to engage the same surface of the form to position said other end portion at a location spaced laterally outward from the same surface of the form.

17. The support of claim 14, wherein the support comprises wire formative.

18. The support of claim 17, wherein the wire formative is made of steel.

19. The support of claim 14, wherein the wire member is free of any openings through the wire member for receiving a fastener.

20. The support of claim 14, wherein the wire member comprises a frangible portion formed in one of the wire sections.

* * * * *